US006112968A

United States Patent [19]

Jin et al.

[11] Patent Number: 6,112,968

[45] Date of Patent: Sep. 5, 2000

[54] CONNECTOR PLATE APPLICATION APPARATUS WITH CONNECTOR PLATE LOADING ALIGNMENT

[75] Inventors: Kathy Liuhui Jin, Chesterfield; Marc Olden, Pacific, both of Mo.

[73] Assignee: MiTek Holdings, Inc., Wilmington, Del.

[21] Appl. No.: 09/483,284

[22] Filed: Jan. 14, 2000

[51] Int. Cl.[7] ..... B27F 7/02

[52] U.S. Cl. ..... 227/2; 227/95; 227/152; 29/417

[58] Field of Search ..... 227/2, 6, 40, 45, 227/93, 95, 86, 96, 152; 29/417, 432

[56] References Cited

U.S. PATENT DOCUMENTS

| | | | |
|---|---|---|---|
| 3,895,708 | 7/1975 | Jureit et al. | 206/53 |
| 3,913,816 | 10/1975 | Jureit et al. | 227/95 |
| 3,939,548 | 2/1976 | Jureit et al. | 29/432 |
| 3,964,663 | 6/1976 | Jureit et al. | 227/95 |
| 4,025,028 | 5/1977 | Jureit et al. | 227/95 |
| 4,033,025 | 7/1977 | Jureit et al. | 29/417 |
| 4,081,893 | 4/1978 | Jureit et al. | 227/152 |
| 5,979,733 | 11/1999 | Matlock | 227/152 |

*Primary Examiner*—Scott A. Smith

*Attorney, Agent, or Firm*—Senniger, Powers, Leavitt & Roedel

[57] ABSTRACT

A connector plate application apparatus presses connector plates into wood members to connect them together for forming wood frames, truss components and the like. Connector plates are supplied to the apparatus in the form of a strip which is pre-punched with nailing teeth. The connector plates are sheared from the strip and driven into the wood members by drivers. The strip is fed forward automatically by a strip feed which engages the strip in openings left by punching the nailing teeth. Loading of a new strip of connector plates is facilitated by an alignment mechanism which allows non-visual alignment of the strip with the strip feed so that the strip feed engages the strip in the openings.

18 Claims, 8 Drawing Sheets

CONNECTOR PLATE APPLICATION APPARATUS WITH CONNECTOR PLATE LOADING ALIGNMENT

BACKGROUND OF THE INVENTION

This invention relates generally to apparatus for applying connector plates and more particularly to such apparatus which has a load alignment feature to assist in loading a continuous strip of connector plates into the apparatus.

Machines for application of connector plates from a continuous strip of connector plates are well known in the industry. An example of such a machine is Model No. 35500 Coilfed Machine available from MiTek Industries, Inc. of St. Louis, Mo. Another example of such a machine is shown in U.S. Pat. No. 3,913,816. These machines are characterized by their use of a coil of connector plates, such as shown in U.S. Pat. No. 3,895,708, rather than preformed individual plates. The coil connector plates are pre-punched with teeth after the fashion of conventional nailing or connector plates, but there is no separation of a metal web into discrete plates. The machines automatically feed coil connector plate strip into position and shear individual connector plates from the strip by the same press platen which drives the teeth of the connector plate into wood members to be joined by the connector plate. In the examples mentioned, connector plates are driven into the wood members from both below and above by separate drivers.

Coil plate machines of the type described have several applications, including the assembly of hip girders for a larger roof truss structure, wooden frames for box springs or furniture as well as many other applications. The operator arranges the wood members on a table of the machine in the desired configuration of the article to be formed through connection of the wood members by the connector plates. A joint between the wood members is located in a position between the drivers for application of the connector plates. The machine is activated by the operator to feed forward lengths of coil connector plates from separate coils into registration with respective press platens below and above the wood members joint. The press platens move toward the joint after the lengths of connector plate strip have been fed forward, shearing connector plates from the respective strips of connector plates and driving the connector plates down into the wood members at the joint. Teeth from each connector are embedded in both wood members at the joint to form a rigid connection of the members. The drivers retract their respective platens, and the wood members can be removed from the machine as a connected unit by the operator. The machine is ready for connecting the next wood members. As shown by U.S. Pat. No. 3,913,816 coil plate machines can be incorporated with a conveyor for feeding wood members into position under the press platens.

It is known to provide a device to detect when the end of one of the coils has been reached to disable the machine from feeding the coil connector plate strip or activating the drivers. When the coil is exhausted, it is replaced with a new coil. The strip of connector plates in the new coil must be loaded into the machine so that it can be automatically fed forward from the coil. When the new strip is loaded into the machine, it must be properly aligned with a drive mechanism in the machine which grips and drives the strip. Conventionally, it has been up to the operator to visually align the end of the strip with the drive mechanism. Failure to properly align the strip upon loading can result in jamming or misfeeds of connector plate strip, and can also seriously damage the machine.

SUMMARY OF THE INVENTION

Among the several objects and features of the present invention may be noted the provision of connector plate application apparatus which can be reliably loaded with a new strip of connector plates; the provision of such an apparatus which does not rely upon visual confirmation by the operator that proper loading has been achieved; the provision of such apparatus which can be loaded rapidly; the provision of such apparatus which has fewer jams and misfeeds; the provision of such apparatus which is inhibited from operation unless the connector plate strip is loaded; the provision of such apparatus which is easy to operate.

Connector plate application apparatus constructed according to the principles of the present invention is used to apply connector plates from a strip of connector plates to wood members for connecting the members together. The connector plate strip has preformed teeth and openings therein. Generally, the apparatus comprises a connector plate strip holder adapted to hold a quantity of the connector plate strip for feeding from the holder to the apparatus. A guide guides the strip of connector plates within the apparatus as the strip is driven by a strip feed adapted to selectively index predetermined lengths of the strip of connector plates forward from the connector plate strip holder along the guide. The strip feed includes a strip entraining device engageable with the strip of connector plates in the openings and an actuator for actuating the strip entraining device to index the strip. A driver positioned for receiving the lengths of the strip of connector plates fed by the strip feed from the guide is adapted to shear a connector plate from the strip of connector plates and to press the teeth of the connector plate into the wood members. A load alignment stop and the guide are mounted on the apparatus for movement relative to each other between an operating position in which the guide defines a continuous path for the strip of connector plates from the connector plate strip holder to the driver, and a load position in which a leading edge of a new strip of connector plates being fed into the apparatus is engageable with the alignment stop and the openings of the connector plate strip are aligned with the strip entraining device.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
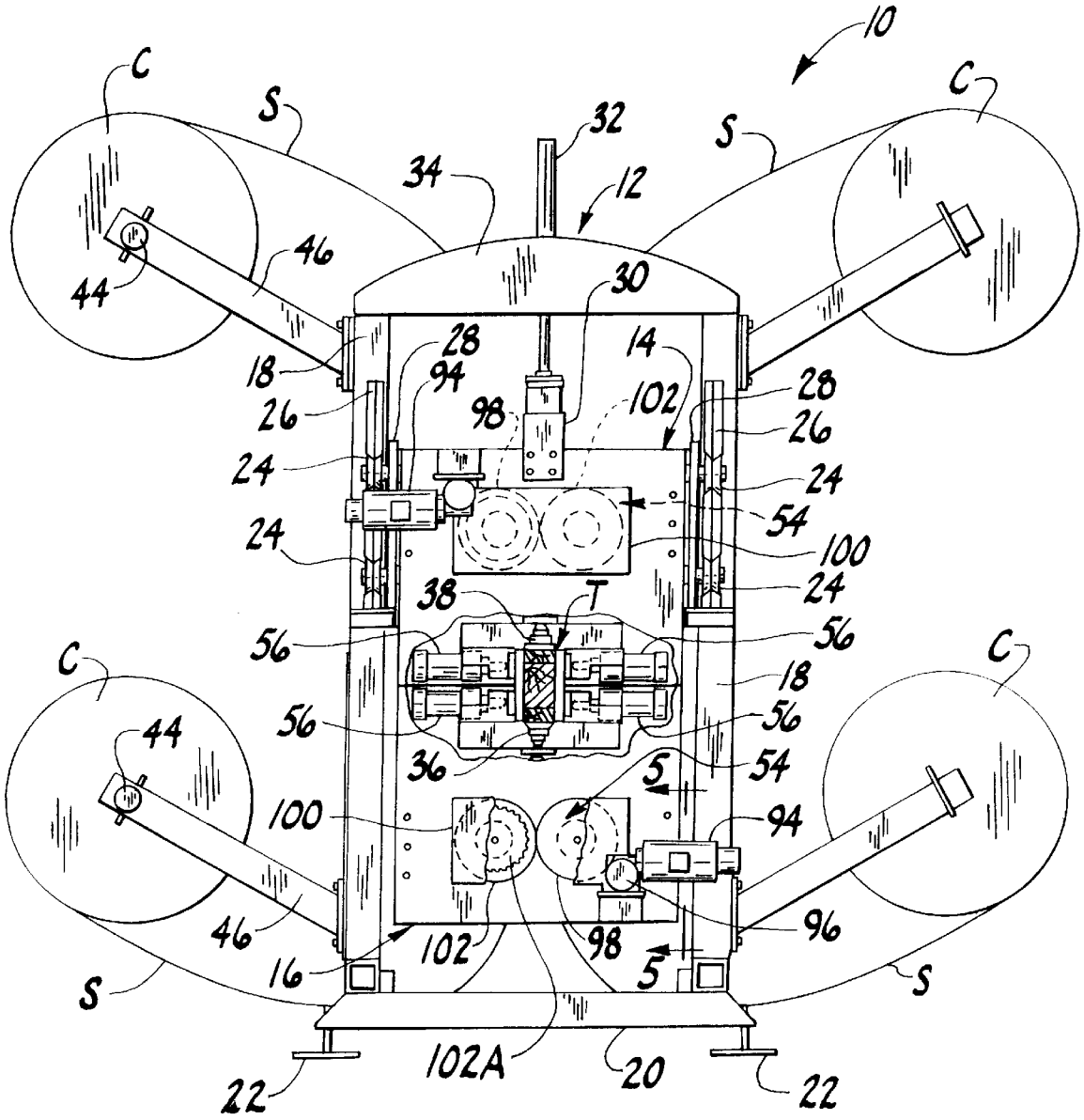
FIG. 1 is an elevational view of apparatus for application of connector plates to a flat truss, with parts broken away to reveal internal construction.
Figure 2:
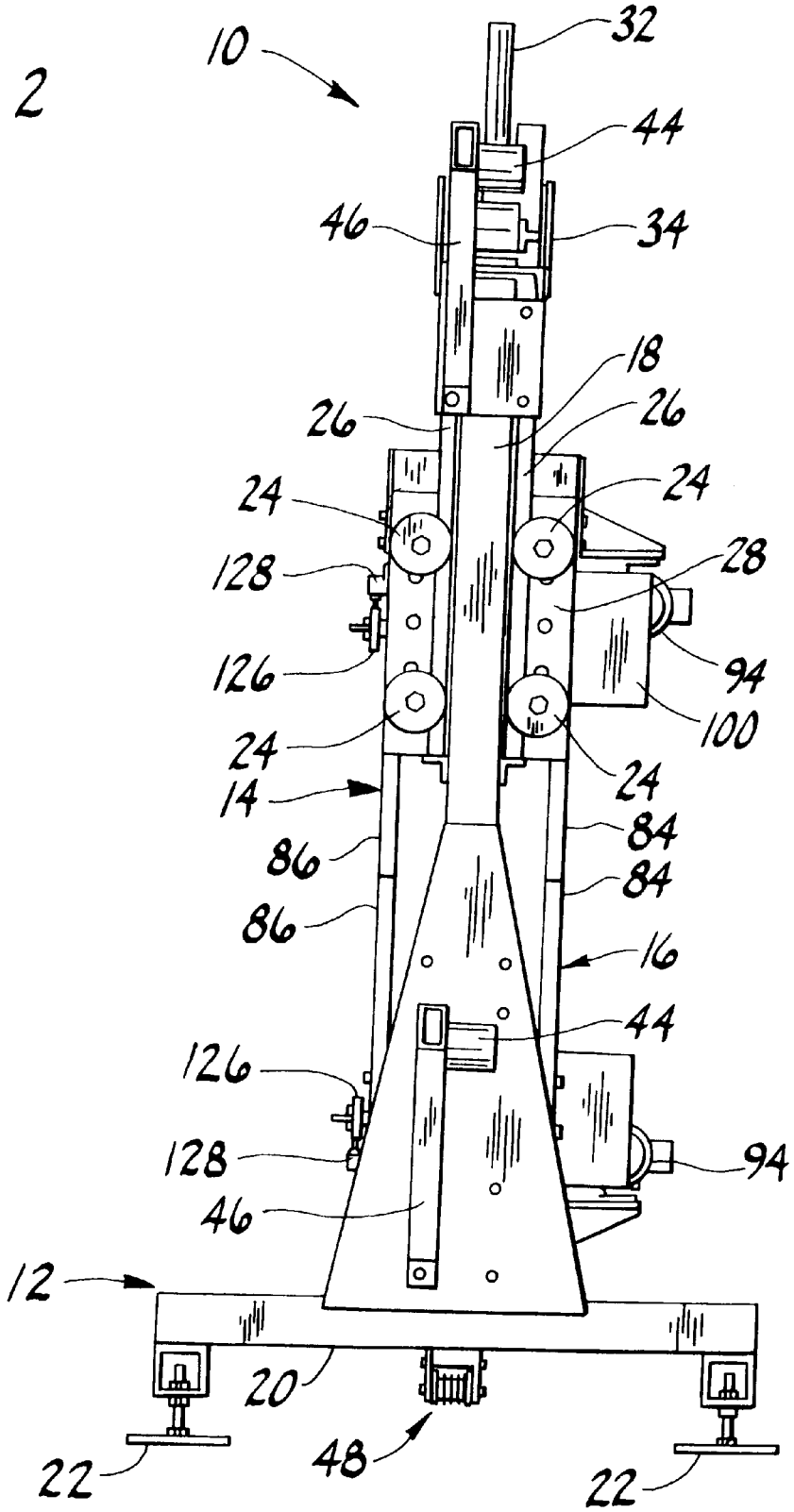
FIG. 2 is a left side elevational view of the apparatus.
Figure 10:
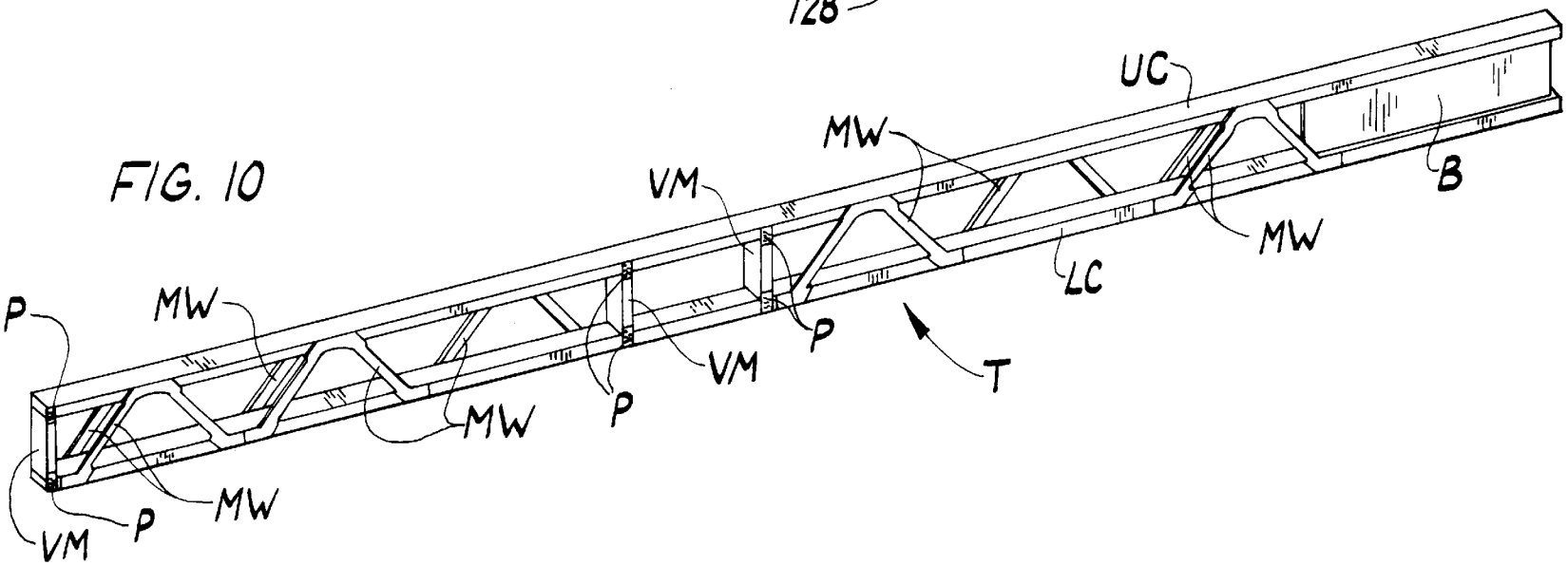
FIG. 10 is a perspective view of a flat truss manufactured using the apparatus of the present invention.

Referring now to the drawings, and in particular to FIGS. 1 and 2, connector plate application apparatus constructed according to the principles of the present invention is designated generally at 10. The particular embodiment of the apparatus 10 illustrated and described herein is preferably used as part of an automated flat truss assembly machine, shown and described in co-pending U.S. provisional application Ser. No. 60/145,516 filed Jul. 23, 1999, which is incorporated herein by reference. However, it is to be understood that the apparatus 10 of the present invention could be used apart from the truss assembly machine. A flat truss T of the type which may be formed by the machine is shown in FIG. 10. The truss T includes an upper chord UC, a lower chord LC and plural metal webs MW connecting the upper and lower chords. A pair of vertical wood members VM are located near the center of the truss, and other is located at the end. An oriented strand board B is secured as by gluing to the upper and lower chords. This board, along with the upper and lower chords, can be sawn through to change the length of the truss. In the truss assembly machine, the apparatus 10 performs the function of securing the vertical wood members VM to upper and lower chords UC, LC of the truss T. More particularly connector plates P are automatically applied to each vertical member VM at the upper and lower ends of the vertical member, and on both sides by the apparatus 10. On the plates on one side of the truss T may be seen in FIG. 10.

The apparatus 10 differs from conventional connector plate application apparatus, such as the Model No. 35500 Coilfed Machine of MiTek Industries, Inc., described above. Connector plates P are applied from opposite sides, rather from top and bottom, and four connector plates, from four separate coils of connector plates are applied to the truss T at one time, rather than two. However, it is understood that the features of the present invention have equal application to connector plate application apparatus having a more conventional arrangement like the Model No. 35500 Coilfed Machine.

The apparatus 10 comprises a frame 12 supporting an upper connector plate application unit 14 and a lower connector plate application unit 16 (the reference numerals designating their subjects generally). The upper and lower units 14, 16 define a central opening for receiving the flat truss T into and through the apparatus 10. As will be described more fully below, the upper unit 14 applies an opposing pair of connector plates P to the upper chord and vertical members VM of the flat truss T, while the lower unit 16 applies an opposing pair of connector plates to the lower chord and the vertical members. The lower unit 16 is fixedly mounted on vertical stanchions 18 of the frame 12 which are supported off the floor by a rectangular subframe 20 including four adjustable feet 22. The upper unit 14 is also mounted on the vertical stanchions 18, but for vertical movement relative to the lower unit 16. More particularly, the upper unit 14 includes two sets of opposing pairs of wheels 24 riding on tracks 26 located on opposite sides of each vertical stanchion 18. The tracks are V-shaped in cross section and are formed by angle irons welded to the stanchions 18. The wheels 24 in each of the opposing pair sets are mounted on a plate 28 connected to the upper unit 14. The upper unit is also attached by a coupling 30 to a lead screw 32 which extends through and is supported by a top cross member 34 of the frame 12 extending between the vertical stanchions 18. The lead screw 32 is engaged with a drive shaft driven by an electric motor (not shown) for rotation of the lead screw to raise and lower the upper unit 14 relative to the lower unit 16. The upper unit is shown in FIG. 1 in a fully lowered position abutting the lower unit 16. By raising the upper unit, the height of the opening defined by the upper and lower units 14, 16 is increased to accommodate trusses having a greater depth. As the lead screw 32 acts to raise or lower the upper unit 14, the wheels 24 ride along the track 26 maintaining the relative horizontal position of the upper and lower units 14, 16. The truss T is supported on by lower rollers 36 through the apparatus 10. Other powered conveyors (not shown) may be used with the apparatus for automatically driving the truss through the apparatus. Spring-mounted upper rollers 28 engage the upper chord UC of the truss to help hold the truss together and in position in the apparatus.

Figure 4:
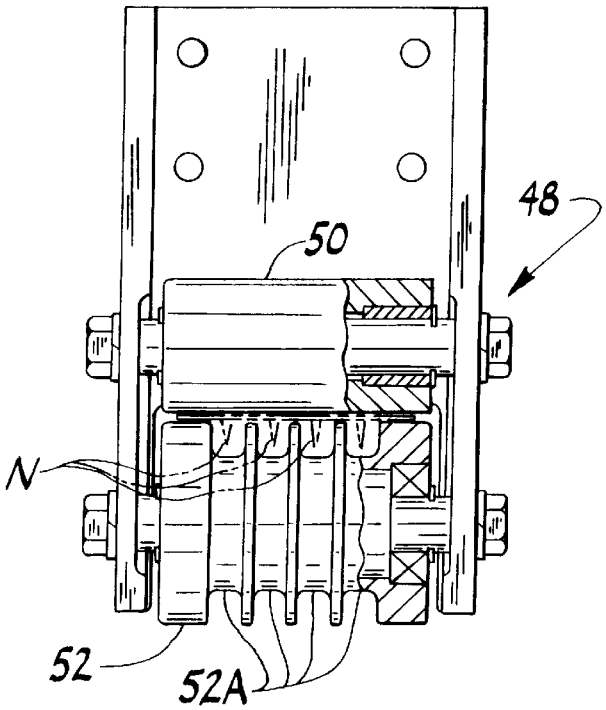
FIG. 4 is a greatly enlarged, schematic view of infeed rollers for the connector plate strip.

The apparatus 10 holds four continuous strips S of connector plates, each in the format of a coil C. The coils C are supported for rotation on spindles 44 of arms 46 mounted on the stanchions 18. Each arm and spindle collectively constitute a connector plate strip holder in the preferred embodiment. The upper two coils C supply strips of connector plates S for the upper unit 14 and the lower two coils supply strips of connector plates for the lower unit 16. Each strip S is a continuous web of metal into which integrals teeth (or nails) N are formed as by punching from the metal web in a conventional manner. An example of a coiled strip of connector plates is shown in U.S. Pat. No. 3,895,708. The strip S from each coil C is fed through a respective first pinch roller pair, generally indicated at 48, into the apparatus 10. As shown in FIG. 4, each first pinch roller pair includes a smooth roller 50 and a grooved roller 52 having grooves 52A which receive the teeth N of the strip of connector plates S so that the strip is pinched between the rollers 48 without interference from the teeth. There are four roller pairs 48 on the apparatus 10, one for each coil C of connector plate strip. All have substantially the same construction, although their orientation on the apparatus and with respect to each other varies with the orientation of the connector plate strip S (e.g., whether the teeth face upward or downward). The first roller pair 48 shown in FIG. 4 is from the lower unit 16 and positioned so as to accept the strip S with the teeth N pointing downward.

Figure 3:
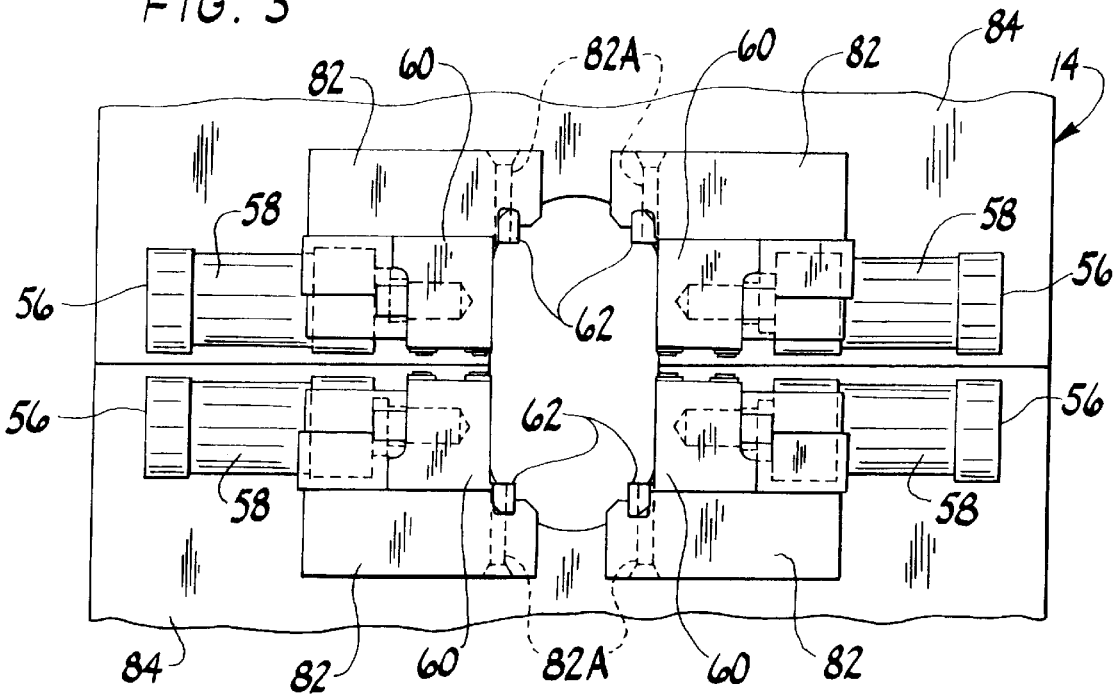
FIG. 3 is an enlarged, schematic, fragmentary view of the apparatus showing drivers for shearing connector plates from the strip and driving these into wood members.

Each strip S passes from its corresponding roller pair 48 into a guide which directs the strip into a strip feed mechanism, generally indicated at 54, operable to feed the strip S in predetermined lengths toward a corresponding driver 56. The driver is positioned to shear a connector plate P from the connector plate strip S and drive it into the vertical member VM and either the upper chord UC or lower chord LC of the truss T. As shown in FIG. 3, there are four drivers 56 in the apparatus 10, each are being dedicated for shearing and driving connector plates P from a particular strip. The operation of the driver 56 to shear a connector plate P from the strip S and press the connector plate into the truss components is well known. The drivers 56 each comprise a cylinder 58 and a press platen 60 driven by the cylinder to engage the strip of connector plates S for shearing off a connector plate P and then driving into the truss T. The drivers 56 further include hardened shearing elements 62 located adjacent on an upstream edge of the platens 60 to assist in shearing each connector plate P from the strip S. The shearing elements are slotted for receiving the teeth N of the connector plate strip. The operation of the individual drivers 56 is essentially the same as those in the aforementioned Model No. 35500 Coilfed Machine available from MiTek Industries, Inc. of St. Louis, Mo. The drivers 56 of the apparatus 10 of the present invention are oriented to drive the connector plates P horizontally, rather than in a vertical direction as in prior machines. Accordingly, no additional description of the drivers 56 will be made herein.

Figure 5:
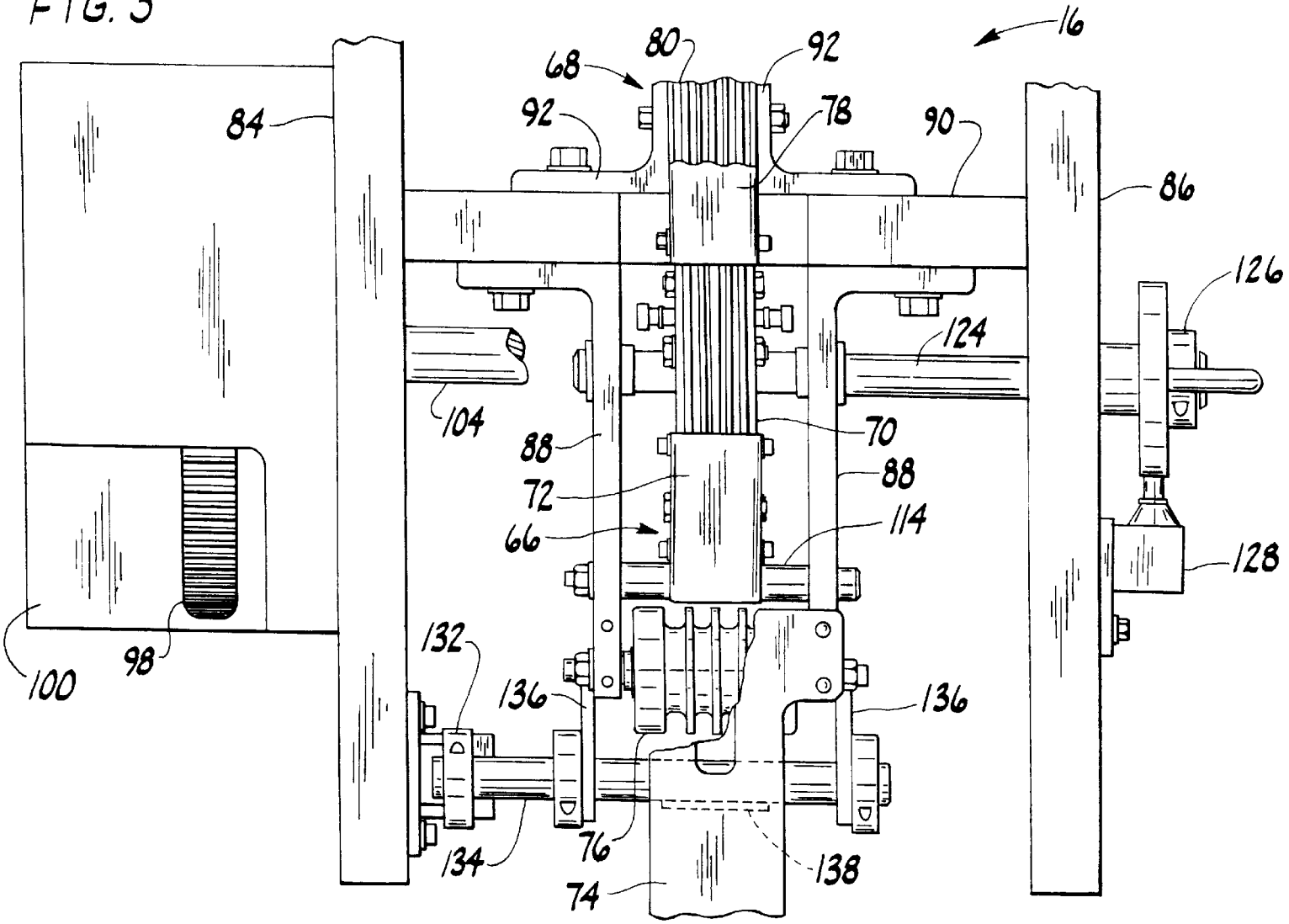
FIG. 5 is a schematic, enlarged, fragmentary side elevational view of the apparatus taken from the vantage indicated by line 5—5 of FIG. 1, with parts including an electric motor and gear reduction box removed for clarity of illustration.

There is one guide for each strip of connector plates S fed into the apparatus 10, and each guide is generally designated by reference numeral 64. The construction of the guides 64 is all the same, although the guides in the upper unit 14 are inverted with respect to the lower unit 16. A description of the right hand guide 64 of the lower unit 16 will be provided which suffices as a description of all four guides of the apparatus. The connector strip guide 64 comprises a first guide section and a second guide section (generally indicated at 66 and 68, respectively). As shown in FIG. 5, the first guide section 66 is below the second guide section 68. The first guide section includes a slotted track 70 and an outer shield 72 between which the connector plate strip S is received. The slotted track is formed by securing together plural rectangular bars so that they face the strip of connector plates S edge on. The rectangular bars are connected together with bolts and spacers so that slots are defined between adjacent bars to receive the teeth N of the connector plate strip S. The outer shield 72 engages the smooth surface of the connector plate strip (opposite the surface from which the teeth project). A slide 74 extends below the lower end of the slotted track 70 (in an upstream direction relative to the direction of travel of the strip) and curves outwardly to facilitate a change in direction of the strip S in the apparatus 10 from a generally horizontal to a generally vertical direction. A grooved guide entry roller 76 is positioned opposite the slide 74 adjacent the lower end of the slotted track 70 to facilitate entry of the strip S into the track. The construction of the guide entry roller 76 is essentially identical to the grooved roller 52 of the first pinch roller pair 48. The grooves on the roller 76 receive the teeth N of the strip. The roller 76 guides the teeth into the slots of the track 72, inhibiting them from catching on the lower end of the track.

The outer shield 72 extends upwardly in registration with the slotted track 70 about half way up the track. Thus the smooth surface of the connector plate strip S is exposed at the upper end of the first guide section 66 for use in feeding the strip forward, as will be described hereinafter. The strip S is sandwiched between the slotted track 70 and the outer shield 72 where the two are in registration, holding the strip from any substantial movement in directions perpendicular to the track and shield. The teeth of the connector plate strip S are held in the slots as a result of the spacing of the outer shield 72 from the track 70. The side flaps 72A of the outer shield 72 extend inwardly over the sides of the track 70 and form a barrier engageable with the longitudinal edges of the strip S to prevent any substantial movement of the strip laterally of the track and outer shield.

The second guide section 68 has a construction similar to the first guide section 66 and is arranged end-to-end with the first guide section. An outer shield 78 is mounted on a slotted track 80 formed in the same way as the slotted track 70 of the first guide section 66. The outer shield and slotted track of the second guide section 68 are substantially co-extensive. Side flaps 78A of the outer shield extend inwardly over the sides of the track 80 for holding the strip S from any substantial lateral movement relative to the second guide section. The strip S exiting the second guide section 68 enters a passage 82A in a guide block 82 which holds the strip and guides it relative to the associated driver 56 for shearing of a connector plate P from the strip. The guide 64 of the lower unit 16 is supported by front and rear walls 84, 86 of the lower unit. As shown in FIG. 5, the first guide section 66 is mounted on a first pair of brackets 88 connected to plates 90 mounted on the front and rear walls 84, 86, respectively, of the lower unit 16. It is noted that the nearer of the brackets 88 as would be seen in FIGS. 6–8 has been removed to illustrate the guides 64. The grooved guide entry roller 76 is also mounted between the first brackets 88. The second guide section 68 is mounted on a second pair of brackets 92 connected to the same plates 90 as the first brackets 88.

The exposed smooth surface of the connector plate strip S near the upper end of the first guide section 66 is engageable by the strip feed mechanism 54 for feeding the strip toward the driver 56. The strip feed mechanism 54 is substantially identical to the coil advance drive disclosed in co-assigned U.S. application Ser. No. 09/347,326, filed Jul. 2, 1999, which application is incorporated herein by reference. Briefly, the strip feed mechanism 54 includes an electric motor 94 connected by a gear reduction box 96 to a first drive gear 98 housed in a gear compartment 100 on the front wall 84 of the apparatus 10. The first drive gear 98 is enmeshed with a second drive gear 102 of the same size in the gear compartment so that the drive gears rotate conjointly. The first drive gear 98 is mounted on a first shaft 104 extending through and journalled in the front and rear walls 84, 86 of the apparatus. The second drive gear 102 is mounted on a second shaft 106 also extending through and journalled in the front and rear walls 84, 86 of the apparatus. First and second drive wheels are indicated in their entireties by reference numerals 108 and 110, respectively. The drive wheels are mounted on the first and second shafts 104, 106 are engageable with the connector plate strips S to drive the strips forwardly to the drivers 56. It will be understood that a single motor 94 (broadly, "actuator") powers the driving of both connector plate strips associated with the lower unit 16. A substantially identical strip feed mechanism 54, including a motor 94, is found on the upper unit 14, which will not be further described. Operation of the motor 94 to feed the correct length of strip forward is described in the aforementioned U.S. application Ser. No. 09/347,326. Briefly, photoelectric sensors (not shown) are used to detect the position of the second drive gear 102. One sensor directly views the teeth of the second drive gear 102 to detect the amount of rotation. Two other sensors view specially formed cogs on a locator gear 102A attached to the second drive gear for conjoint rotation with the second drive gear to detect the absolute position of the second drive gear. It is to be understood that the strip feed mechanism could be cylinder driving through a linear reciprocating motion without departing from the scope of the present invention.

The drive wheels 108, 110 are identical so that a description of the first drive wheel will suffice for both. The first drive wheel 108 comprises two thin sprocket gears 112 mounted in spaced apart locations on the first drive shaft 104. The precise number of gears used may be more or less than two without departing from the scope of the invention, and depends upon the width of the strip being fed. The first wheel 108 is aligned with the slotted track 70 at the location above the termination of the outer shield 72 so that the smooth surface of the connector plate strip S is exposed to the drive wheel. The teeth of the sprocket gears 112 are received in openings on the smooth surface of the strip left when the nailing teeth N are punched from the web of metal to form the strip of connector plates S for entraining the strip on the first drive wheel 108. The sprockets 112 are rotationally offset from each other so that gear teeth on the sprocket can engage the longitudinally staggered openings in the connector plate strip S. The rotational offset of the sprockets 112 can be adjusted to accommodate different offsets between laterally adjacent openings in different strips. Rotation of the first drive wheel 108 when actuated by the motor 94 causes the strip S to be fed upwardly toward the driver 56 through engagement of the sprocket gear teeth in the openings of the strip.

The present invention is particularly related to loading connector plate strip S into the apparatus 10 prior to the onset of operation, or as needed to reload during operation. It is important during loading of a new strip that the openings in the strip be aligned with the sprocket gear teeth of the first drive wheel 108. It is known to shear off the leading edge of the strip S so that the holes are spaced a certain distance from the leading edge corresponding to the position of the sprocket gear teeth. However, it is necessary for the leading edge to be properly positioned within the apparatus when it is inserted.

The first guide section 66 is mounted near its lower end between the first brackets 88 on a pin 114 for pivoting motion relative to the first brackets. The first guide section 66 is able to pivot between an operating position and a load position. In the operating position (FIG. 8), the first and second guide sections 66, 68 are aligned to define a continuous path for the strip of connector plates S from the coil to the driver 56. In the load position (FIG. 7), the first guide section 66 is out of alignment with the second guide section 68 so that a leading edge of a new strip of connector plates S fed into the apparatus 10 through the first guide section engages an alignment stop 116. In the illustrated embodiment, the alignment stop 116 constitutes the lower end of the second guide section 68. However, it is envisioned that a surface (not shown) not associated with the second guide section 68 could be used to provide the necessary alignment. Moreover, the alignment stop could be moved to block the advance of the connector plate strip S while the first guide section 66 remains stationary. When the leading edge of the strip engages the lower end 116 of the second guide section 68, the strip is aligned for reception of the sprocket gear teeth into the opening in the strip. However, the strip S is spaced inwardly from the sprocket gear teeth of the first drive wheel 108. The first guide section 66 may then be moved back to an operating position which brings the leading edge of the strip into alignment with the second guide section 68, and also causes the strip to engage the first drive wheel 108.

Figure 7:
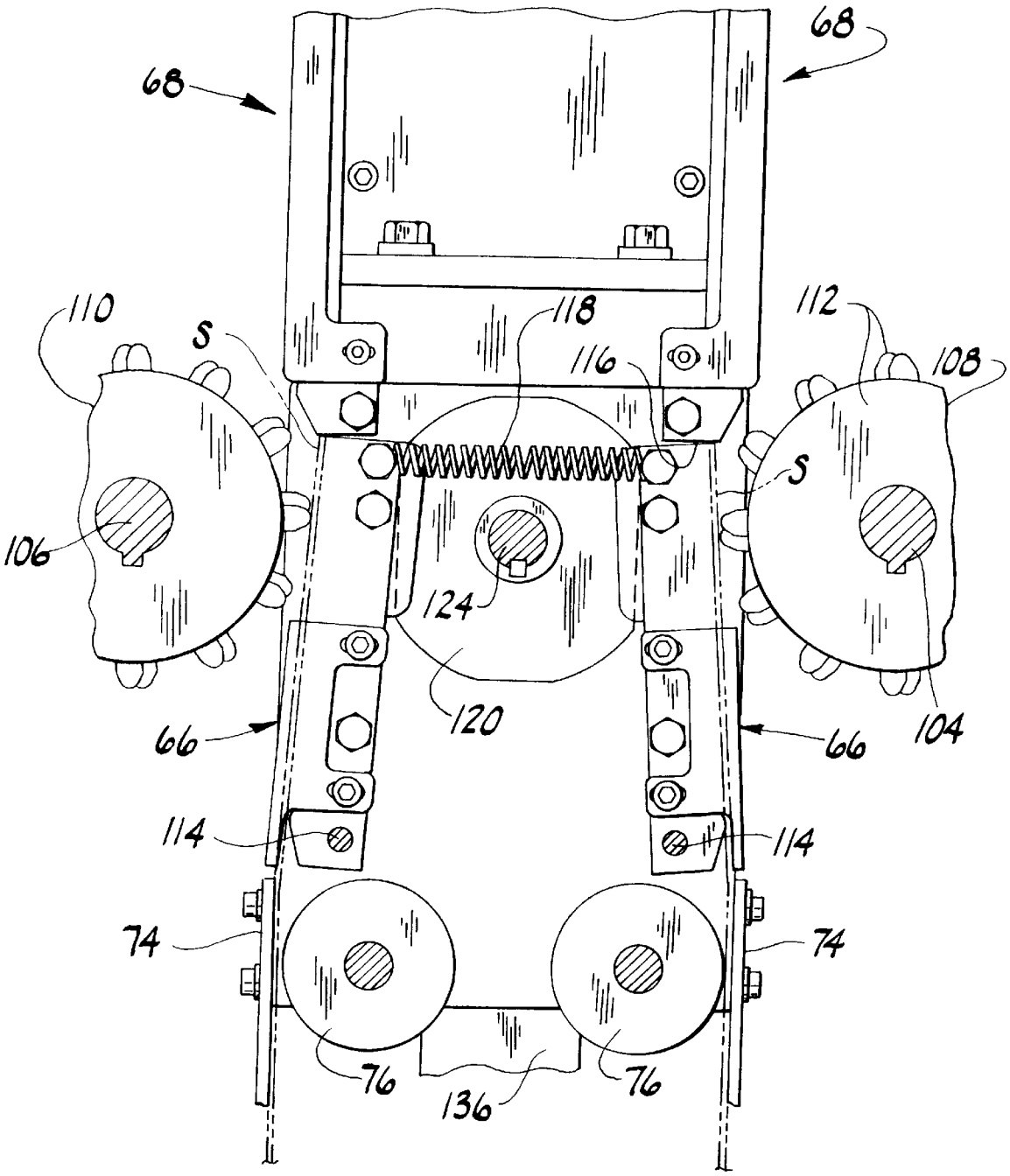
FIG. 7 is a further enlarged, fragmentary view of one of the guides showing a first guide section of the guide in a load position for loading a strip of new connector plates from a new coil into the apparatus.
Figure 8:
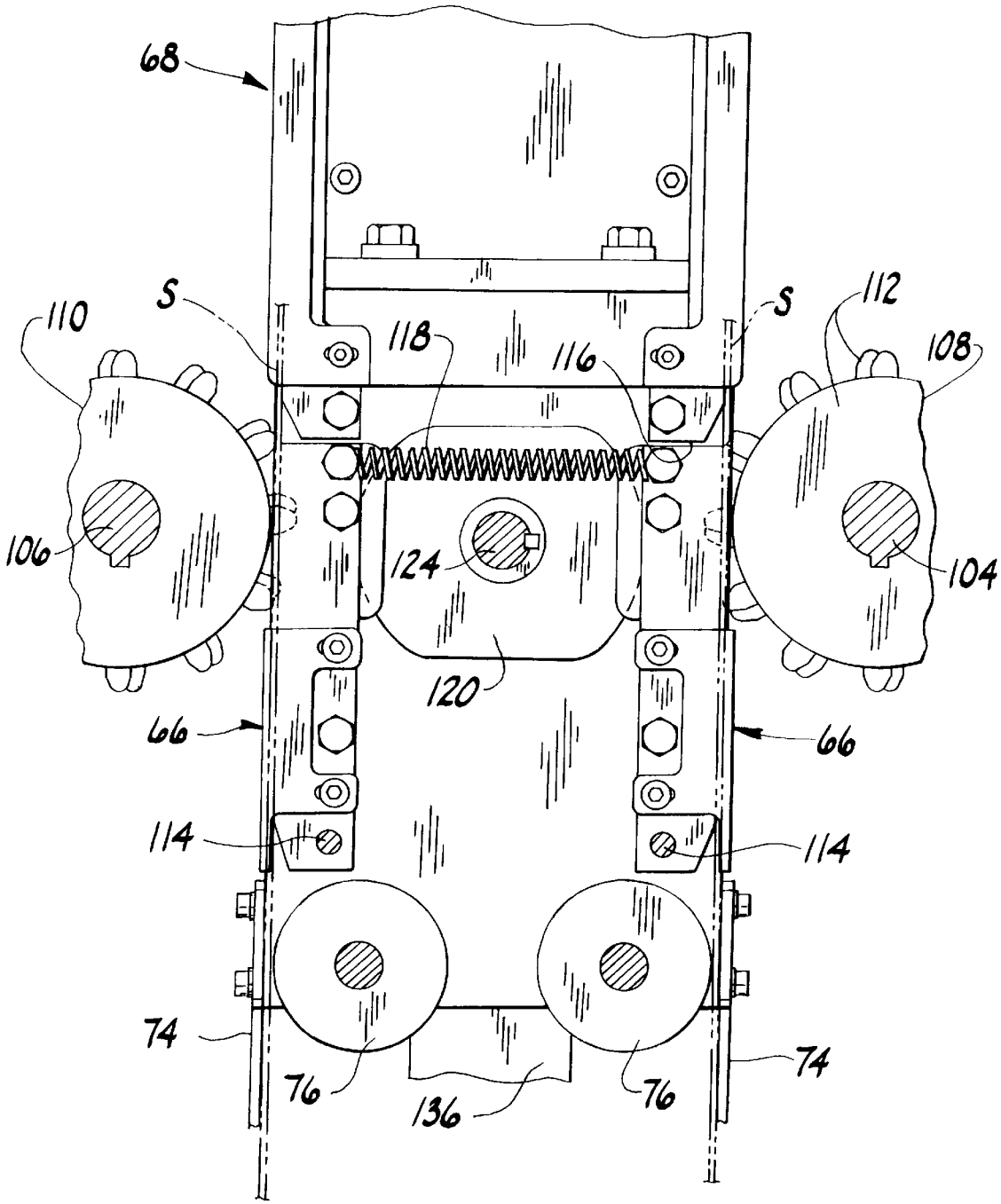
FIG. 8 is the enlarged, fragmentary view of FIG. 7, but with the first guide section in an operating position.
Figure 9B:
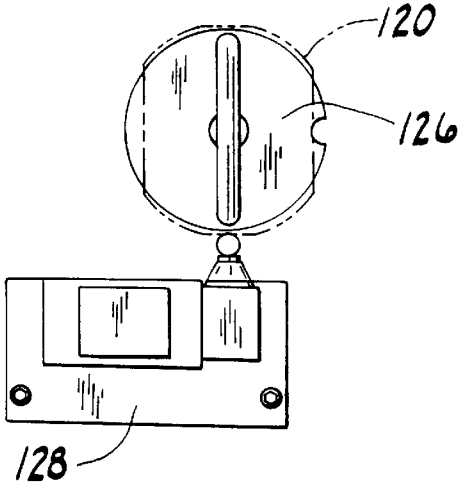
FIG. 9 is a schematic elevational view of a knob for using in moving the first guide sections of the lower unit between the load and operating positions.
Figure 9A:
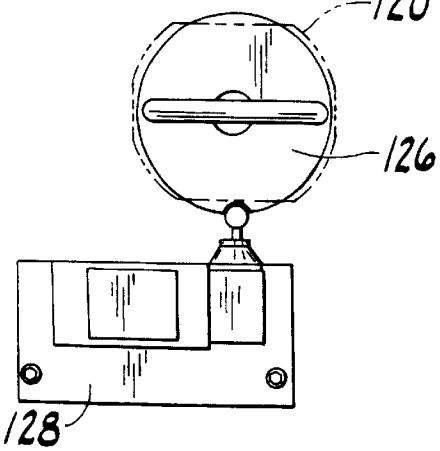

Movement of the first guide section 66 is accomplished by a spring 118 and a cam 120. The spring 118 is connected by bolts 122 to the upper end of the first guide section 66, and also to the upper end of the first guide section of the adjacent guide on the lower unit 16. The spring 118 biases the first guide sections 66 toward the load position, that is, to pivot inwardly out of alignment with their corresponding second guide sections 68. The generally oval cam 120 is positioned to engage the tracks 70 of the first guide sections 66 to pivot the first guide sections outwardly to the operating position. The cam 120 is mounted on a camshaft 124 journalled in the 88 brackets and extending through the rear wall 86 of the lower unit 16. A knob 126 (FIG. 2) on the outer end of the camshaft 124 can be grasped and turned to rotate the camshaft to move the cam 120 between a disengaged position (FIG. 7) in which the spring 118 is free to pivot the first guide sections 66 to the load position, and an engaged position (FIG. 8) in which the cam engages the first guide sections and pivots them against the bias of the spring to the operating position. A proximity switch 128 associated with the knob 126 disables the feed motor 94 when the knob is turned to the load position so that the connector plate strip S will not be inadvertently fed while the first guide sections 66 are out of alignment with the second guide sections 68. FIGS. 9A and 9B illustrate the two positions of the knob 126 and its engagement or disengagement with the proximity switch 128. The corresponding position of the cam 120 is illustrated in phantom in FIGS. 9A and 9B. The cam 120, camshaft, knob 126 and spring 118 constitute a switching device in the preferred embodiment. A substantially identical switching device is provided on the upper unit 14 for moving the first guide sections 66 of the upper unit in the same manner as the first guide sections of the lower unit 16.

Figure 6:
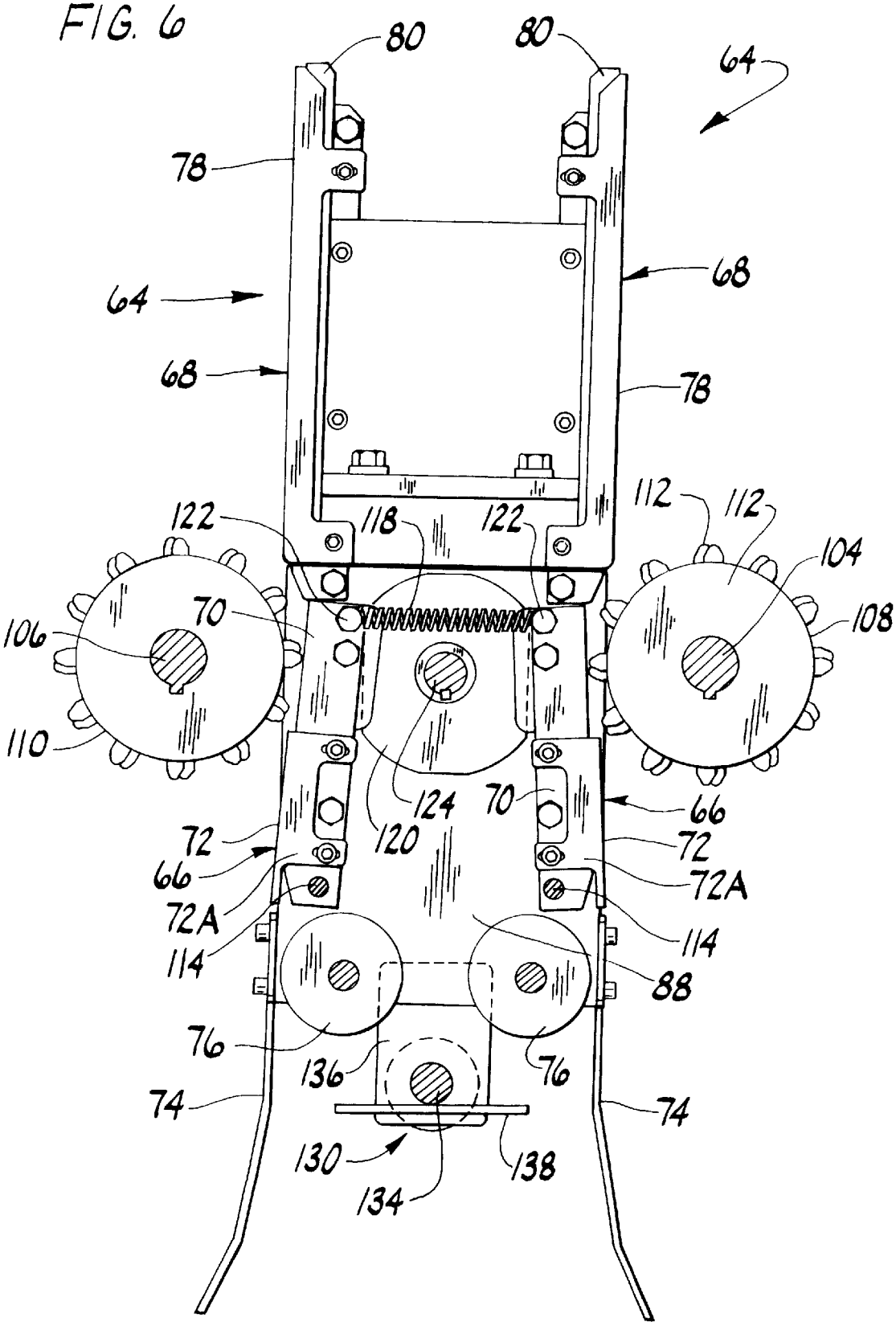
FIG. 6 is a front elevational view of connector plate strip guides of the lower unit.

Referring to FIGS. 5 and 6, an end of coil detector, generally indicated at 130, is capable of detecting that a coil C of connector plate strip has been exhausted and automatically prevents the apparatus 10 from operating. One end of coil detector 130 is provided for the lower unit 16 and another end of coil detector (not shown) is provided for the upper unit 14, the construction and operation of the two being identical. The end of all connector plate strips S are formed with a bend (not shown) which is used for securing the strip to the spool of the coil C. The bend projects out of the normal plane of the strip. The end of coil detector 130 comprises a rotary limit switch 132 mounted in part on a shaft 134 just under the guide 64. The shaft extends through supports 136 depending from the first brackets 88. As shown in FIG. 6, a trip plate 138 fixedly mounted on the shaft 134 between the guides 64 of the lower unit 16 extend toward the paths of the connector plate strip S of both guides. In ordinary operation, the strip S is spaced substantially from the trip plate 138 as it passes along the slide 74 into the first guide section 66. However, at the end of the strip S, the bent end projects laterally outwardly substantially from the slide 74 opposite the end of coil detector 130. The bent end engages the trip plate 138, causing it to pivot upward as the bent end passes the plate. Pivoting of the trip plate 138 turns the shaft 134 and the limit switch 32 so that the limit switch deactivates the apparatus 10 and causes a signal to be made that one of the coils C is exhausted.

It will be understood from the foregoing that proper alignment of the connector plate strip S can be achieved when loaded into the apparatus 10 of the present invention to avoid misfeeds and jams and to simplify the loading operation. After an existing coil of connector plate strip is exhausted, an empty spool which held the coil is removed from the spindle 44 and a new coil C is placed on the spindle. A leading edge portion of the new connector plate strip S is fed out and the leading edge is trimmed so that pre-selected openings in the strip are spaced a predetermined distance from the leading edge. The camshaft knob 126 is turned to the load position (FIG. 7), causing the cam 120 to disengage the first guide sections 66 and allowing the spring 118 to pivot the guide sections to the load position out of alignment with the second guide sections 68. The new strip S is fed through the first pinch roller pair 48 and upward (assuming one of the coils on the lower unit 16 is being replaced) to the guide. The leading edge of the strip passes first between the slide 74 of the first guide section 66 and the guide entry roller 76, and thence into the space between the outer shield 72 and the track 70 in which the teeth N of the strip are received between the rods of the track. As the leading edge of the strip S passes the downstream end of the first guide section 66, it engages the closed end 116 of the second guide section track 70. The strip cannot be advanced forward any further. The engagement of the leading edge of the strip S aligns openings in the strip with sprocket gear teeth 112 of the drive wheel 108. The knob 126 is turned to move the cam 120 into engagement with the first guide sections 66, pivoting them outwardly into the operating position (FIG. 8). At the same time, the sprocket gear teeth 112 engage the strip S in the openings for use in driving the strip S. Returning the knob 126 to the operating position triggers the proximity switch 128 to allow the motor to operate for driving the strip S forward into the drivers 56.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. Connector plate application apparatus for applying connector plates from a strip of connector plates to wood members for connecting the members together, the connector plate strip having preformed teeth and openings therein, the apparatus comprising:

a connector plate strip holder adapted to hold a quantity of the connector plate strip for feeding from the holder to the apparatus;

a guide for guiding the strip of connector plates within the apparatus;

a strip feed adapted to selectively index predetermined lengths of the strip of connector plates forward from the connector plate strip holder along the guide, the strip feed including a strip entraining device engageable with the strip of connector plates in the openings and an actuator for actuating the strip entraining device to index the strip;

a driver positioned for receiving the lengths of the strip of connector plates fed by the strip feed from the guide, the driver being adapted to shear a connector plate from the strip of connector plates and to press the teeth of the connector plate into the wood members;

a load alignment stop, the guide and the alignment stop being mounted on the apparatus for movement relative to each other between an operating position in which the guide defines a continuous path for the strip of connector plates from the connector plate strip holder to the driver, and a load position in which a leading edge of a new strip of connector plates being fed into the apparatus is engageable with the alignment stop and the openings of the connector plate strip are aligned with the strip entraining device.

2. Connector plate application apparatus as set forth in claim 1 wherein the guide comprises a first guide section and a second guide section in generally end-to-end relation with each other, the first guide section being mounted for pivoting movement relative to the second guide section between the operating position and the load position.

3. Connector plate application apparatus as set forth in claim 2 further comprising a switching device for selectively moving the first guide section between the operating and load positions.

4. Connector plate application apparatus as set forth in claim 3 wherein the switching device is operatively connected to the strip actuator so that the strip actuator is inoperable to move the strip of connector plate when the switching device has moved the first guide section to the load position.

5. Connector plate application apparatus as set forth in claim 3 wherein the first guide section is adapted to pivot about one end thereof.

6. Connector plate application apparatus as set forth in claim 3 wherein the switching device comprises a cam engageable with the first guide section for selectively moving the first guide section between the operating and load positions.

7. Connector plate application apparatus as set forth in claim 6 wherein the strip feed switching device further comprises a spring connected to the first guide section for biasing the first guide section toward the load position, the cam being adapted to move the first guide section against the bias of the spring to the operating position.

8. Connector plate application apparatus as set forth in claim 7 wherein the alignment stop is defined by an end of the second guide section.

9. Connector plate application apparatus as set forth in claim 7 wherein the strip feed actuator is operatively connected to the cam so that the actuator is inoperable when the cam is moved to place the first guide section in the load position.

10. Connector plate application apparatus as set forth in claim 2 further comprising an upper unit and a lower unit defining an opening sized and shaped to receive the wood members in the form of a flat truss, the lower unit including the connector plate strip holder, the guide, the strip feed and the driver, the upper unit comprising a connector plate strip holder, a guide including first and second guide sections for guiding the strip of connector plates within the apparatus, the first guide section being pivotable between an operating position and a load position, a strip feed adapted to selectively index predetermined lengths of the strip forward from the connector plate strip holder along the guide, the strip feed including a strip entraining device for engaging the strip of connector plates in the openings and a actuator for actuating the strip entraining device to index the strip, and a driver positioned for receiving the lengths of the strip of connector plates fed by the strip feed from the guide, the driver being adapted to shear a connector plate from the strip of connector plates and to press the teeth of the connector plate into the wood members.

11. Connector plate application apparatus as set forth in claim 10 further comprising a frame mounting the upper unit for vertical movement relative to the lower unit thereby to selectively change the size of the opening defined by the upper and lower units to accommodate flat trusses of different heights.

12. Connector plate application apparatus as set forth in claim 11 wherein the lower unit further includes a second connector plate strip holder, a second guide for guiding a second strip of connector plates and a second driver, all having substantially the same construction as the holder, guide and driver of the lower unit, and wherein the upper unit comprises a second connector plate strip holder, a second guide for guiding a second strip of connector plates and a second driver, all having substantially the same construction as the connector plate strip holder, the guide and the driver of the upper unit, whereby the apparatus is adapted to apply connector plates to opposite sides of the truss at an upper and a lower margin of the truss.

13. Connector plate application apparatus as set forth in claim 12 wherein the strip feed of the lower unit is adapted to simultaneously drive the two strips of connector plates of the lower unit, and the strip feed of the upper unit is adapted to simultaneously drive the two strips of connector plates of the upper unit.

14. Connector plate application apparatus as set forth in claim 12 further comprising a switching device for selectively moving the first guide section between the operating and load positions.

15. Connector plate application apparatus as set forth in claim 14 wherein the switching device comprises a first cam engageable with the first guide sections of the lower unit for selectively moving the first guide sections between the operating and load positions, and a second cam engageable with the first guide sections of the upper unit for selectively moving the first guide sections between the operating and load positions.

16. Connector plate application apparatus as set forth in claim 15 wherein the switching device is operatively connected to the strip feeds of the upper and lower units so that the strip feeds are inoperable to feed the strips when the switching device is in the load position.

17. Connector plate application apparatus as set forth in claim 1 further comprising a conveyor for conveying the wood members through the apparatus.

18. Connector plate application apparatus as set forth in claim 1 further comprising a sensor for detecting an end of a strip of connector plates, the sensor being operatively connected to the strip actuator for disabling the strip actuator upon detection of the end of the strip.

* * * * *